US008556755B1

(12) United States Patent
Zackery

(10) Patent No.: US 8,556,755 B1
(45) Date of Patent: Oct. 15, 2013

(54) SPORTS SWING TRAINER

(76) Inventor: Stephon Douglas Zackery, Conyers, GA (US)

( * ) Notice: Subject to any disclaimer, the term of this patent is extended or adjusted under 35 U.S.C. 154(b) by 0 days.

(21) Appl. No.: 13/531,866

(22) Filed: Jun. 25, 2012

Related U.S. Application Data

(60) Provisional application No. 61/572,871, filed on Jul. 25, 2011.

(51) Int. Cl.
*A63B 69/00* (2006.01)

(52) U.S. Cl.
USPC ..... 473/453; 473/422; 473/424

(58) Field of Classification Search
USPC ..... 473/422, 437, 457, 451, 453, 229, 458, 473/212, 213; D21/694, 753, 721; 482/109, 482/121, 122
See application file for complete search history.

(56) References Cited

U.S. PATENT DOCUMENTS 2,134,451 A 5/1935 Mogren
2,655,378 A * 10/1953 Sheffer ..... 473/229
2,716,027 A * 8/1955 Gehri ..... 482/131
3,618,942 A 11/1971 Bates et al.
3,752,474 A * 8/1973 Macabet et al. ..... 482/131
3,979,114 A * 9/1976 Codina ..... 482/131
3,999,752 A * 12/1976 Kupperman et al. ..... 482/131
4,205,839 A * 6/1980 Best ..... 482/131
4,749,189 A * 6/1988 Frank ..... 482/129
5,009,420 A * 4/1991 Martelli ..... 473/458
5,082,262 A 1/1992 Sanchez
5,269,512 A 12/1993 Crowson et al.
5,306,232 A * 4/1994 Whitmyer ..... 482/10
6,245,002 B1 6/2001 Beliakov
6,572,497 B1 6/2003 Halsworth
7,364,516 B2 * 4/2008 Kim ..... 473/409
7,892,103 B2 * 2/2011 Vahary ..... 473/229
8,142,337 B2 * 3/2012 Hall ..... 482/129
8,337,338 B2 * 12/2012 Smed ..... 473/422
2008/0108486 A1 * 5/2008 Vigilia ..... 482/124

* cited by examiner

*Primary Examiner* — Mitra Aryanpour
(74) *Attorney, Agent, or Firm* — Rodgers & Rodgers

(57) ABSTRACT

A sports swing trainer is provided and includes a continuous resilient cable which is attachable by means of spaced straps to a bat or other sports racquet with the straps respectively attached to a pair of pulleys by a rotatable attachment combination and with the opposite end of the resilient cable attachable to a post, fence and the like by means of a combination third pulley and strap arrangement. An athletic workout belt is also attachable to the third pulley by means of a second continuous resilient cable.

7 Claims, 4 Drawing Sheets

SPORTS SWING TRAINER

The benefits under 35 U.S.C. 119 are claimed of provisional patent application 61/572,871 filed Jul. 25, 2011.

BACKGROUND OF THE INVENTION

This invention relates to a swing trainer to develop, condition and strengthen targeted muscle groups in order to promote a proper swing by mimicking specific baseball, tennis, golf, and other sports movement patterns with balanced resistance. The swing trainer attaches to baseball bats, tennis rackets, golf clubs etc. and includes a VELCRO strap for attachment to a fixed object such as a pole or a small tree. It also includes snaps that serve as an alternate attachment method to hook onto a stationary wired fence which surrounds most baseball fields or tennis courts. It is also attachable to a tailgate latch on trucks or SUVs.

The swing trainer is simple and convenient to use. Once properly connected to a fixed pole or fence and the like, it is ready to use. When the user swings in the normal manner, the resistance cables react against the different muscle groups. This promotes muscle strength through conditioning of the muscle and muscle memory that will increase bat and racket swing speed.

Some of the muscle groups conditioned, strengthened and developed by this invention include shoulder muscles (deltoids), back muscles, triceps, biceps, abdominal oblique, gluteus maximus, forearms, thighs and hamstrings.

BRIEF SUMMARY OF THE INVENTION

A swing trainer is provided to develop various muscle groups in order to enhance and improve one's swing when playing various sports. The swing trainer is especially beneficial in improving a batter's swing and tennis player's stroke. The swing trainer comprises a resilient continuous cable threaded through three pulleys and secured at the ends to form a continuous loop. Two of the pulleys are attached to a bat by means of swivel attachment mechanisms respectively which in turn are secured to a pair of VELCRO straps. The third pulley is spaced opposite the first two pulleys and is attached to a third VELCRO strap by means of a swivel attachment. The first two VELCRO straps are spaced apart and attached around the barrel portion of a baseball bat. The third VELCRO strap is attachable to a fence post, small tree and the like.

In an alternative version of the invention, the VELCRO straps which are attached to the bat can be detached from the swivel attachment mechanisms and the quick link elements of the mechanisms are then attachable to other sports equipment such as a tennis racket. In addition, the third VELCRO strap can be detached from the swivel attachment and the attachment is then directly attachable to a wire fence and the like.

An enhanced version of the swing trainer is provided with a second resilient continuous cable which is threaded through a double pulley with an auxiliary pulley spaced from the double pulley and attached to an athletic workout belt by means of a swivel attachment mechanism.

DETAILED DESCRIPTION OF THE INVENTION

Figure 1:
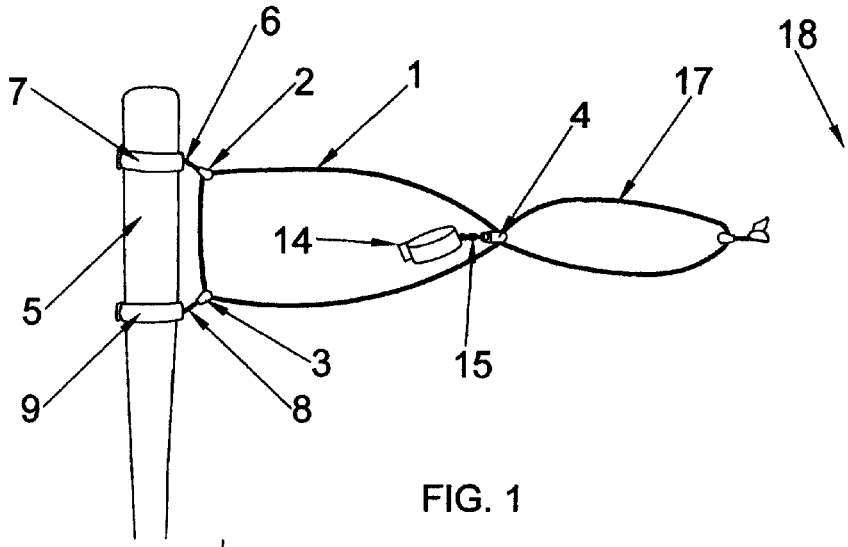
FIG. 1 is a side view of the swing trainer according to this invention.
Figure 2:
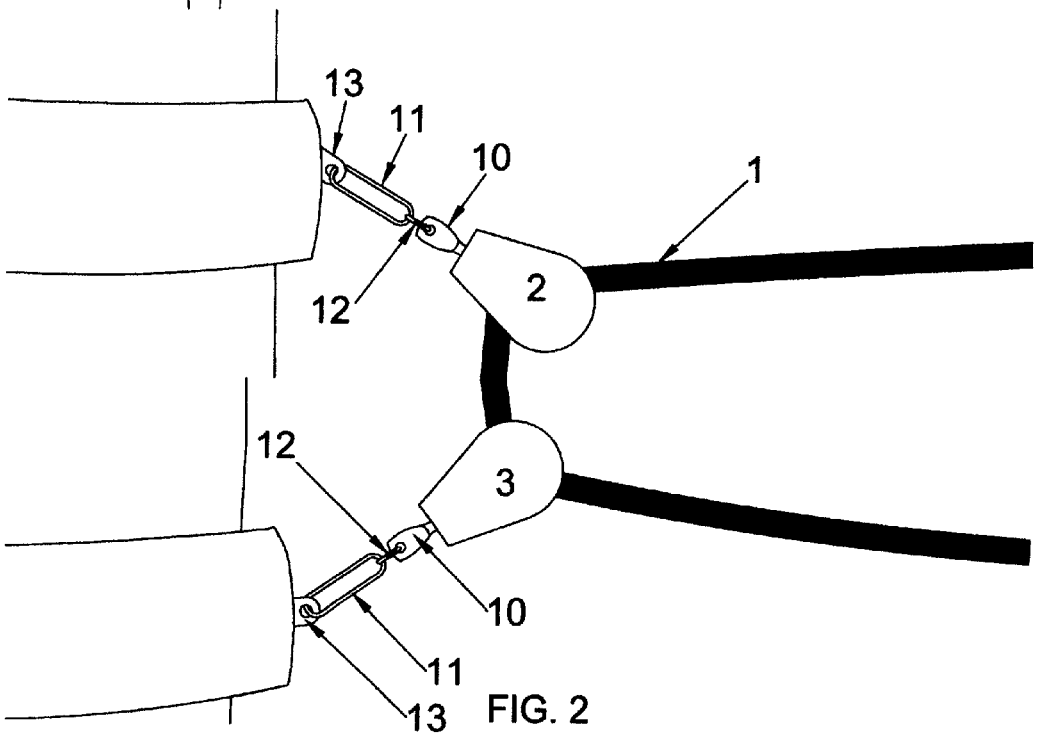
FIGS. 2, 3 and 4 show details of the pulley attachment feature of the invention.

In the drawings and with particular reference to FIG. 1, the swing trainer is shown in detail and includes resilient cable 1 which is threaded through pulleys 2, 3 and 4. Pulley 2 is attached to the upper end of bat 5 by means of a combination of swivel mechanism 6 and VELCRO strap 7. Likewise, pulley 3 is attached to bat 5 by means of a combination of swivel mechanism 8 and VELCRO strap 9. Details of swivel mechanisms 6 and 8 are shown in FIG. 2 and each includes swivel dowel 10 and quick link 11 which are interconnected by inserting quick link 11 through an aperture in swivel dowel 10. Quick links 11 are attached to respective VELCRO straps 7 and 9 by inserting quick links 11 through apertures formed in attachment tabs 13 attached to the respective VELCRO straps 7 and 9. Quick links 11 are generally elongated metal loops with spaced ends which are threaded and the ends interconnected by means of a threaded sleeve. For better balance, VELCRO straps 7 and 9 are spaced apart on bat 5.

Figure 3:
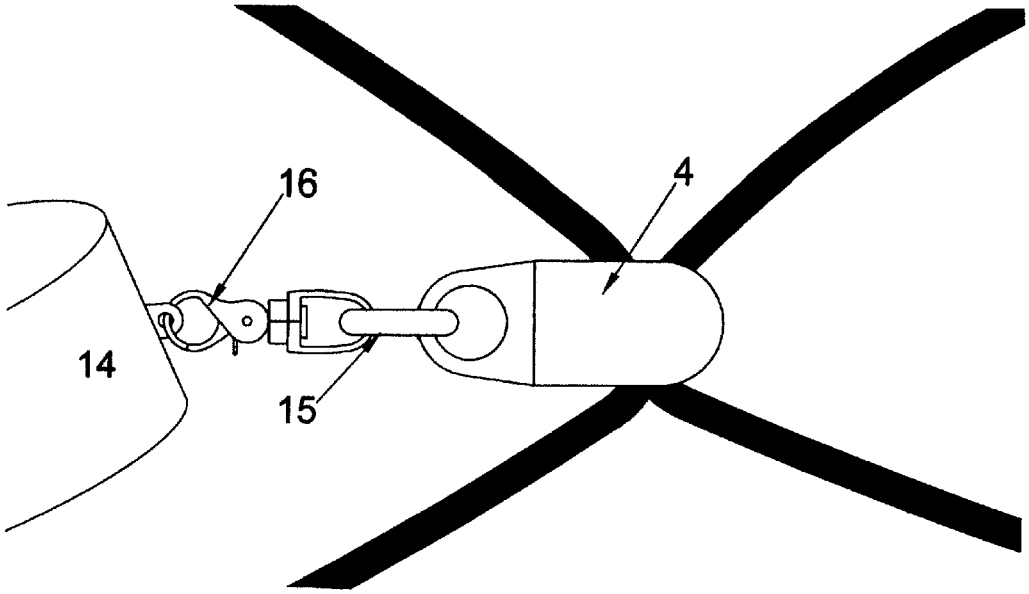

To complete the basic elements of the basic swing trainer, according to this invention and as shown in FIG. 3, pulley 4 is disposed generally remote from pulleys 2 and 3 and is rotatably attached to VELCRO strap 14 by means of a combination of releasable spring snap link 15 and releasable trigger snap link 16.

Figure 4:
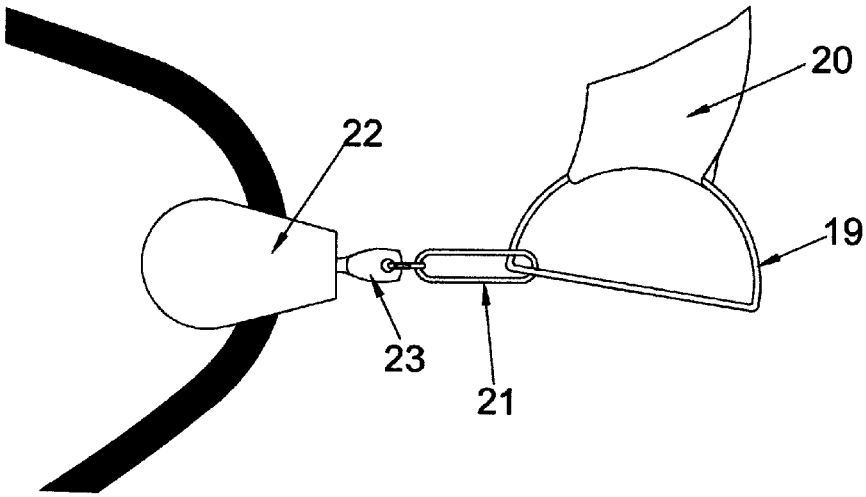

An enhanced embodiment of the swing trainer is shown in detail in FIGS. 1, 3 and 4 wherein a second continuous resilient cable 17 is provided and is threaded through double pulley 4 and attached to workout belt 18 by means of metal loop 19 which is interconnected to attachment flap 20 which is suitably attached to workout belt 18. Metal loop 19 is interconnected to quick link 21 which in turn is secured to auxiliary pulley 22 by means of swivel dowel 23.

Figure 5:
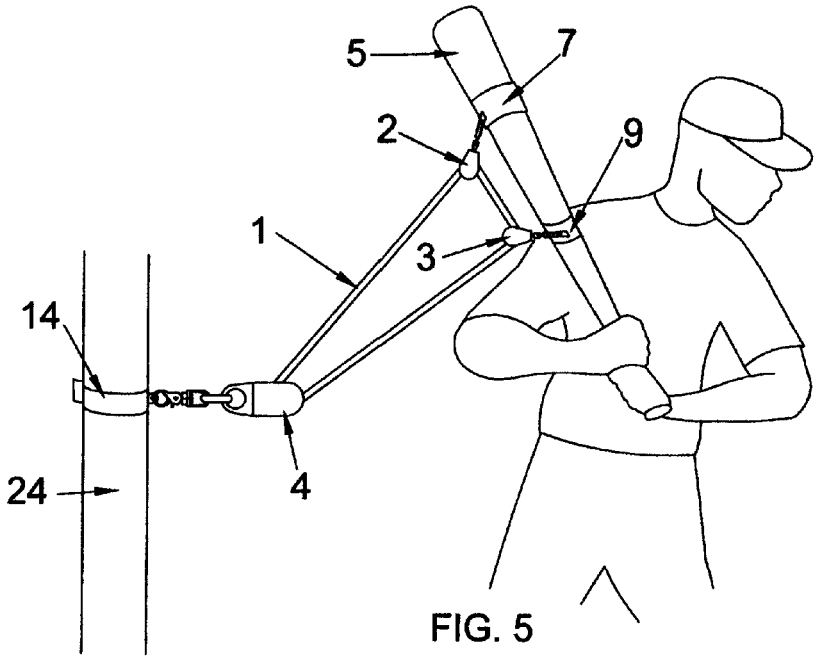
FIG. 5 illustrates the basic form of the swing trainer in the ready position.
Figure 6:
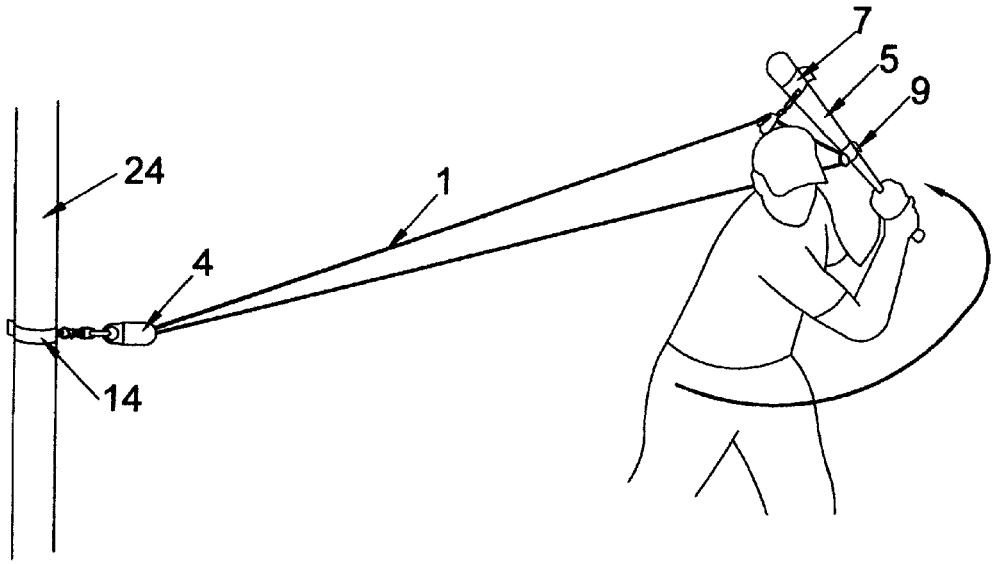
FIG. 6 shows the swing trainer in the extended position.

The operation of the basic swing trainer is shown in FIGS. 5 and 6 wherein VELCRO straps 7 and 9 are attached to bat 5 and VELCRO strap 14 is attached to fence post 24. From the batter's position shown in FIG. 5, the bat is swung in a conventional fashion to the position shown in FIG. 6 by which resilient cable 1 is stretched which results in the strengthening of the batter's abdominal, shoulder and other muscles.

Figure 7:
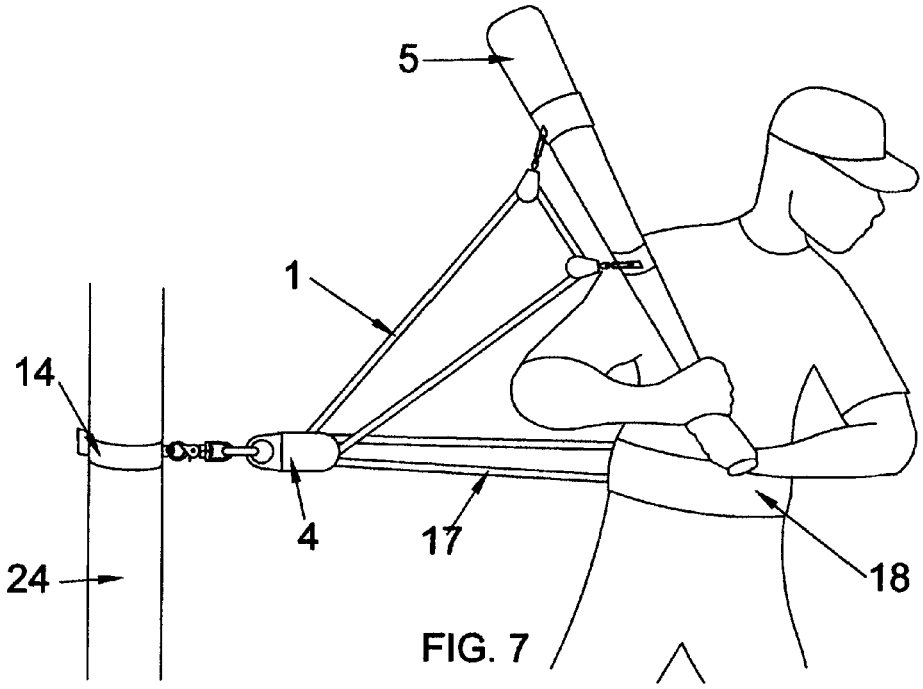
FIGS. 7 and 8 are views similar to FIGS. 5 and 6 and show an alternate embodiment of the swing trainer.
Figure 8:
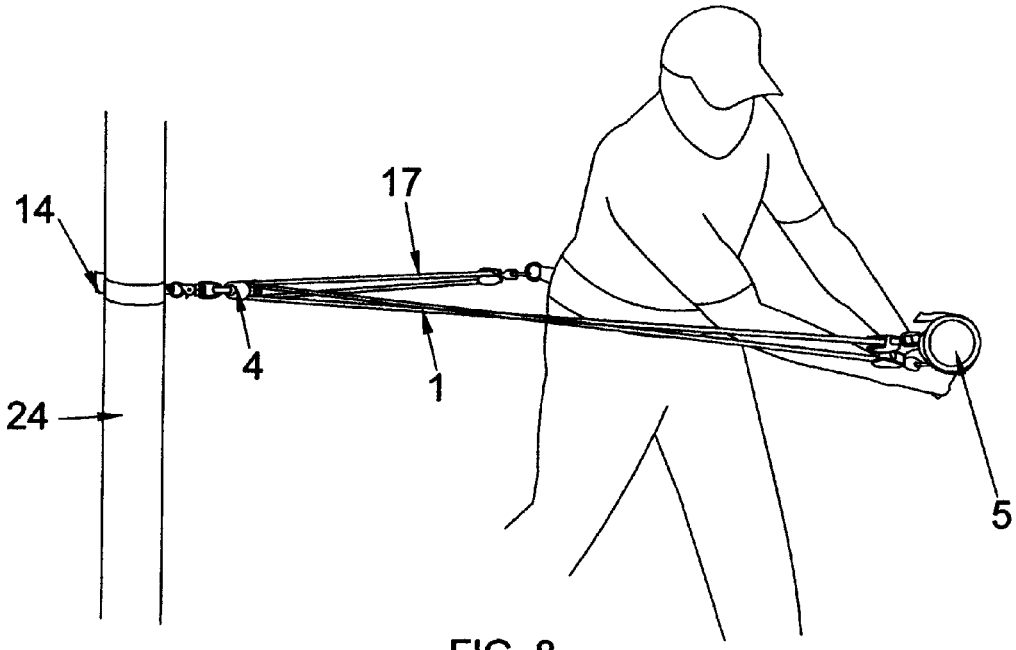

By incorporating athletic workout belt 18 into the swing trainer, as shown in FIGS. 7 and 8, the added resistance of resilient cable 17 attached to athletic workout belt 18 results in the strengthening of the thigh muscles and other related muscle groups.

Therefore, by this invention, a swing trainer is provided which is adjustable depending on the needs of the user and develops strength and swing memory especially in connection with improving one's performance in playing baseball, tennis and other like sports.

The invention claimed is:

1. A sports swing trainer comprising an elongated athletic swing device, a resilient cable formed in a closed continuous loop, a first pair of pulleys interconnected to said cable, a pair of attachment combinations rotatably interconnected respectively to said first pair of pulleys, said attachment combinations being spaced apart and secured to said athletic swing device a third pulley interconnected to said resilient cable generally remote from said first pair of pulleys, said resilient cable passing through said first pair of pulleys, and said third pulley rotatably attached to another attachment combination.

2. A sports swing trainer according to claim 1 wherein each of said pair of attachment combinations comprises an attachment strap secured to a baseball bat.

3. A sports swing trainer according to claim 2 wherein said another attachment combination comprises an attachment strap secured to a fence post.

4. A sports swing trainer according to claim 1 wherein said third pulley is a double pulley and a second continuous resilient cable is interconnected to said third pulley.

5. A sports swing trainer according to claim 4 wherein an athletic workout belt is rotatably interconnected to said second continuous resilient cable.

6. A sports swing trainer comprising a resilient cable formed in a continuous loop, a first pair of pulleys interconnected to said resilient cable, a pair of attachment combinations rotatably interconnected respectively to said first pair of pulleys, a third pulley interconnected to said resilient cable generally remote from said first pair of pulleys, said third pulley rotatably attached to another attachment combination, said third pulley being a double pulley, and a second continuous resilient cable being interconnected to said third pulley.

7. A sports swing trainer according to claim 6 wherein an athletic workout belt is rotatably interconnected to said second continuous resilient cable.

* * * * *